US006945683B2

(12) United States Patent
Gross et al.

(10) Patent No.: US 6,945,683 B2
(45) Date of Patent: Sep. 20, 2005

(54) THIN LAMP ASSEMBLY METHOD

(75) Inventors: Robert D. Gross, Noblesville, IN (US); Larry R. Bennett, Shirley, IN (US)

(73) Assignee: Guide Corporation, Pendleton, IN (US)

( * ) Notice: Subject to any disclaimer, the term of this patent is extended or adjusted under 35 U.S.C. 154(b) by 136 days.

(21) Appl. No.: 10/448,537

(22) Filed: May 30, 2003

(65) Prior Publication Data

US 2004/0240226 A1 Dec. 2, 2004

(51) Int. Cl.[7] ..... F21V 29/00

(52) U.S. Cl. ..... 362/544; 362/158; 362/374; 362/545

(58) Field of Search ..... 362/158, 240, 362/294, 373, 374, 375, 544, 545

(56) References Cited

U.S. PATENT DOCUMENTS

| | | | | | |
|---|---|---|---|---|---|
| 4,477,864 | A | * | 10/1984 | Van Duyn et al. | 362/548 |
| 4,579,534 | A | * | 4/1986 | Lipman et al. | 434/286 |
| 5,038,255 | A | * | 8/1991 | Nishihashi et al. | 362/547 |
| 5,373,280 | A | | 12/1994 | Louy et al. | |
| 5,388,035 | A | | 2/1995 | Bodem, Jr. | |
| 5,528,474 | A | | 6/1996 | Roney et al. | |
| 5,673,995 | A | | 10/1997 | Segaud | |
| 5,762,414 | A | | 6/1998 | Montalan et al. | |
| 5,765,940 | A | | 6/1998 | Levy et al. | |
| 5,785,418 | A | | 7/1998 | Hochstein | |
| 5,921,652 | A | | 7/1999 | Parker et al. | |
| 6,039,466 | A | * | 3/2000 | Duchenne et al. | 362/515 |
| 6,045,247 | A | * | 4/2000 | Fukuhara | 362/543 |
| 6,095,672 | A | | 8/2000 | Beninga et al. | |
| 6,280,480 | B1 | | 8/2001 | Tuttle et al. | |
| 6,299,334 | B1 | | 10/2001 | Schwanz et al. | |
| 6,371,636 | B1 | | 4/2002 | Wesson | |
| 6,406,172 | B1 | | 6/2002 | Harbers et al. | |
| 6,406,173 | B1 | | 6/2002 | Serizawa et al. | |
| 2002/0024822 | A1 | | 2/2002 | Pond et al. | |
| 2002/0063521 | A1 | | 5/2002 | Salam | |
| 2002/0085389 | A1 | | 7/2002 | Cheron et al. | |
| 2002/0117692 | A1 | | 8/2002 | Lin | |

* cited by examiner

*Primary Examiner*—John Anthony Ward
(74) *Attorney, Agent, or Firm*—Ice Miller

(57) ABSTRACT

The subject invention comprises a thin lamp assembly having a lens and a lamp housing heat staked and sealed together. The subject invention further comprises the method of assembling the thin lamp assembly. In one embodiment, the lens has a plurality of plastic stakes and a lens rib located around the lens' periphery. Further, the lamp housing has a plurality of receiving holes around its outer periphery and a lamp housing rib around its inner periphery. In this embodiment, a sealant is placed on the lamp housing and the plastic stakes are inserted into the receiving holes so that the lens rib and lamp housing rib form a seal channel to contain the sealant and the lens is flush with the lamp housing. A heat source is then used to heat treat the plastic stakes to form a plurality of mushroom caps that act to attach the lens to the lamp housing.

23 Claims, 11 Drawing Sheets

THIN LAMP ASSEMBLY METHOD

BACKGROUND OF THE INVENTION

A typical vehicle lamp assembly comprises a housing portion with a reflector containing a rear-loaded filament light bulb and a lens affixed to the open end of the housing. This construction is rather large in size and takes up a considerable amount of depth when housed in a vehicle. As vehicle designs have changed over the years to create more compact vehicles with improved gas mileage, designers have sought ways to reduce the size and space requirements for housing a lamp assembly.

In order to reduce the size of a lamp assembly, vehicle lamp designers have begun to use light emitting diodes (LEDs) instead of filament bulbs. In a LED lamp assembly, LEDs are mounted or placed within a lamp housing and a lens is then affixed and sealed to the open end of the lamp housing. Because LEDs are much smaller and produce less heat than a filament bulb, a lamp assembly containing LEDs is much smaller (thinner) in size. Thus, LED lamp assemblies allow vehicles to be further reduced in size, because less volume is required in the vehicle to house each of the lamp assemblies. Unfortunately, the current method of assembling LED lamp assemblies prevent further reduction in size of the vehicle lamp assembly because of the elements needed to both seal and affix the lens to the lamp housing.

FIG. 1 shows an exploded view of a LED lamp assembly 2. As shown in FIG. 1, LED lamp assembly 2 comprises a lens 3 having a lens leg 4 around die periphery of the lens. Lamp housing 5 has a lens leg channel 6 located around the periphery of the lamp housing. FIG. 1*a* shows a cross-sectional view of an almost fully assembled LED lamp assembly 2 along line A—A of FIG. 1. As shown in FIG. 1*a*, lens leg channel 6 is designed and of sufficient depth and width to accept lens leg 4 and the large amount of sealant required to assemble the lamp assembly. Lens leg 4 and lens leg channel 6 are of sufficient size to provide enough surface area for a sealant to both attach and seal lens 3 to a lamp housing 5.

Further, referring back to FIG. 1, lamp assembly 2 comprises at least one attachment means, such as two clips 8 and two notches 9 on lamp housing 5. Clips 8 fit into notch 9 and on top of lens 3 so that the lens and lamp housing 5 are held together. The attachment means is only used for a period of time sufficient enough to allow the sealant to cure. An LED array 12 is mounted in lamp housing 5 and is covered by lens 3. As used herein, the term "LED array" means a plurality of LEDs arranged on a single circuit board or a plurality of circuit boards.

FIG. 2 shows a flow chart of the steps that comprise the method of assembling LED lamp assembly 2. As shown in step 40, LED array 12 is mounted to lamp housing 5. Step 41 comprises placing a sealant, such as a silicon sealant, into lens leg channel 6. In step 42, lens leg 4 is inserted into lens leg channel 6 so that lens leg 4 seats to the bottom of lens leg channel 6. As shown in step 43, clips 8 are attached to two notches 9 on lamp housing 5 and to lens 3. In this manner, two clips 8 hold lens 3 to lamp housing 5 until the sealant is allowed to cure. As shown in step 44, once the sealant cures around lens leg 4 and in lens leg channel 6, the sealant will attach and seal lens 3 to lamp housing 5 to form LED lamp assembly 2. To accomplish both the attaching and sealing purposes, it will be appreciated by one skilled in the art that a large amount of sealant is required to be used. Further, it will be appreciated by one skilled in the art that the lens leg has to be large enough to provide enough surface area to allow the sealant to both attach and seal the lens to the lamp housing. Moreover, the lens leg channel must be large enough to hold the lens leg and the large amount of sealant required to attach and seal the lens to the lamp housing. The large amount of sealant, the length of lens leg 4 and the depth of lens leg channel 6 are required to both seal and attach lens 3 to lamp housing 5. It is the required amount of sealant, the size of the lens leg and the size of the lens leg channel that prevent designers from obtaining any further reduction in the size of vehicle lamp assemblies.

Accordingly, it is desirable to provide a method of assembling a thin lamp assembly for vehicles that can further reduce the size of the vehicular lamp assembly. In particular, it is desirable to eliminate the lens leg, eliminate the lens leg channel and reduce the amount of sealant needed to seal and attach the lens to the lamp housing.

BRIEF SUMMARY OF THE INVENTION

The subject invention comprises a method of assembling a thin lamp assembly. Further, the subject invention includes the thin lamp assembly produced by this inventive method of assembly.

One embodiment of the method of producing the thin lamp assembly comprises the steps of providing a lens with a lens rib located around the periphery of the lens and a plurality of plastic stakes located sporadically around the periphery of the lens. The method further provides a lamp housing with a lamp housing rib located around its inner periphery and a plurality of receiving holes located on its outer periphery in a location and number that correspond with the number and the location of the plastic stakes of the lens. After a sealant is placed on the lamp housing the lens is then placed over the lamp housing so that plastic stakes are inserted into the receiving holes. In this manner, the lens rib and the lamp housing rib form a seal channel to hold the sealant. A heating device is then used to heat treat each of the plurality of plastic stakes. The heating device heats each of the plurality of plastic stakes to form a mushroom cap that covers each of the receiving holes of the lamp assembly. Once the mushroom caps are formed, the heating device is withdrawn and the plastic stakes cool. Once the plastic stakes cool and the sealant cures, the lens is attached and sealed to the lamp housing.

Thus, one embodiment of the thin lamp assembly of the subject invention comprises a lens with a lens rib and a plurality of plastic stakes located on its periphery. The thin lamp assembly further comprises a lamp housing attached to the lens and a light source enclosed by the lamp housing and lens. The lamp housing has a plurality of receiving holes that contain each of the plastic stakes and a lamp housing rib. The thin lamp assembly further comprises a mushroom cap that covers each of the plastic stakes and receiving holes and a sealant located in a seal channel that is formed by the lens rib and the lamp housing rib. The thin lamp assembly further comprises a light source enclosed by the lamp housing and lens. An alternative embodiment of the subject invention has the plastic stakes located on the lamp housing and the receiving holes located on the lens so that the lamp housing is heat staked to the lens. Other embodiments can have both the lens rib and lamp housing rib located on the lens or have both ribs located on the lamp housing.

DETAILED DESCRIPTION OF THE INVENTION

The subject invention comprises a method of assembling a thin lamp assembly that utilizes a heat staking process. Further, the subject invention comprises the thin lamp assembly with a lens heat staked to a lamp housing.

Figure 1:
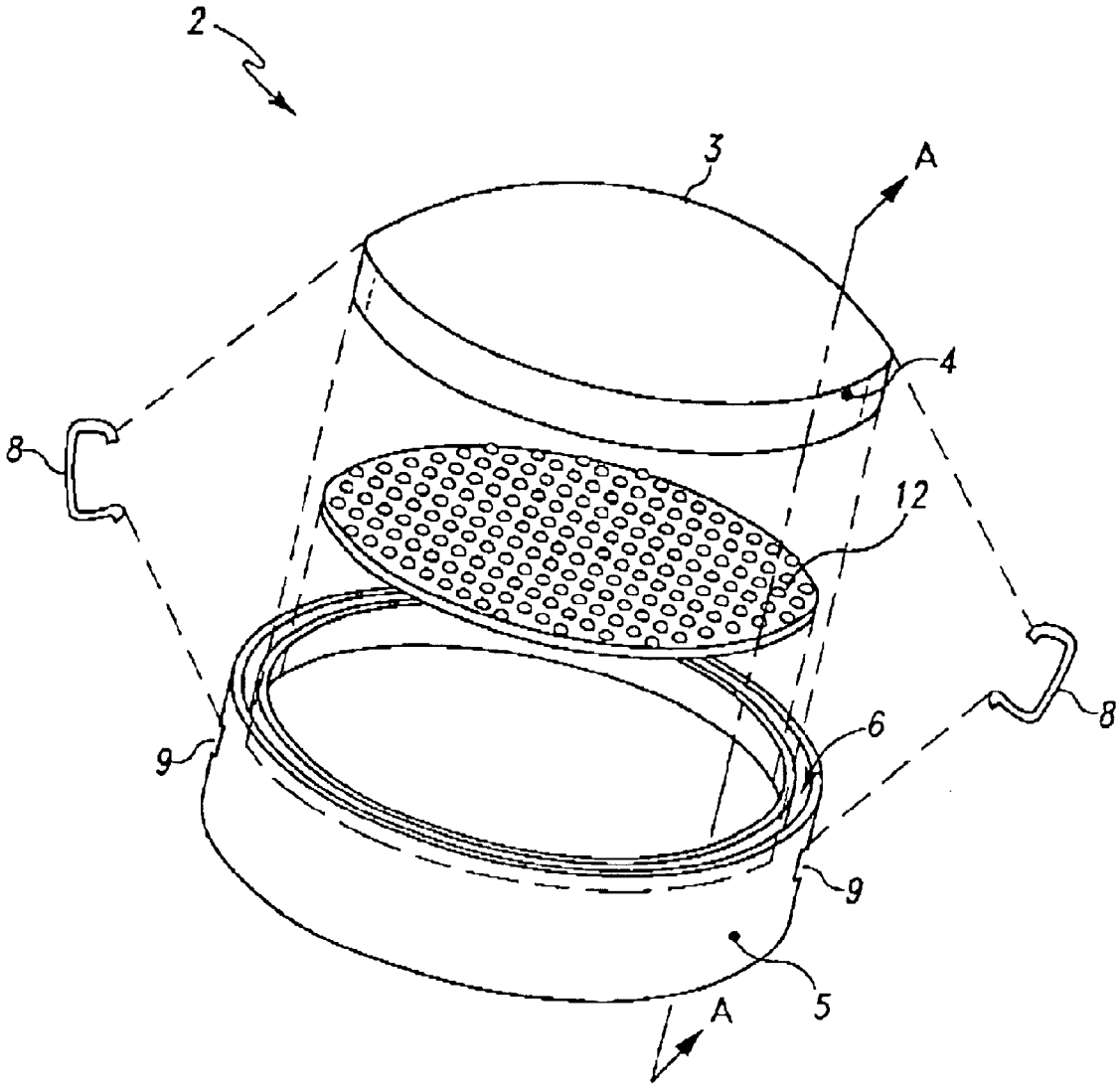
Fig. 1 (Prior Art)
FIG. 1 is an exploded view of a LED lamp assembly known in the art.
Figure 1A:
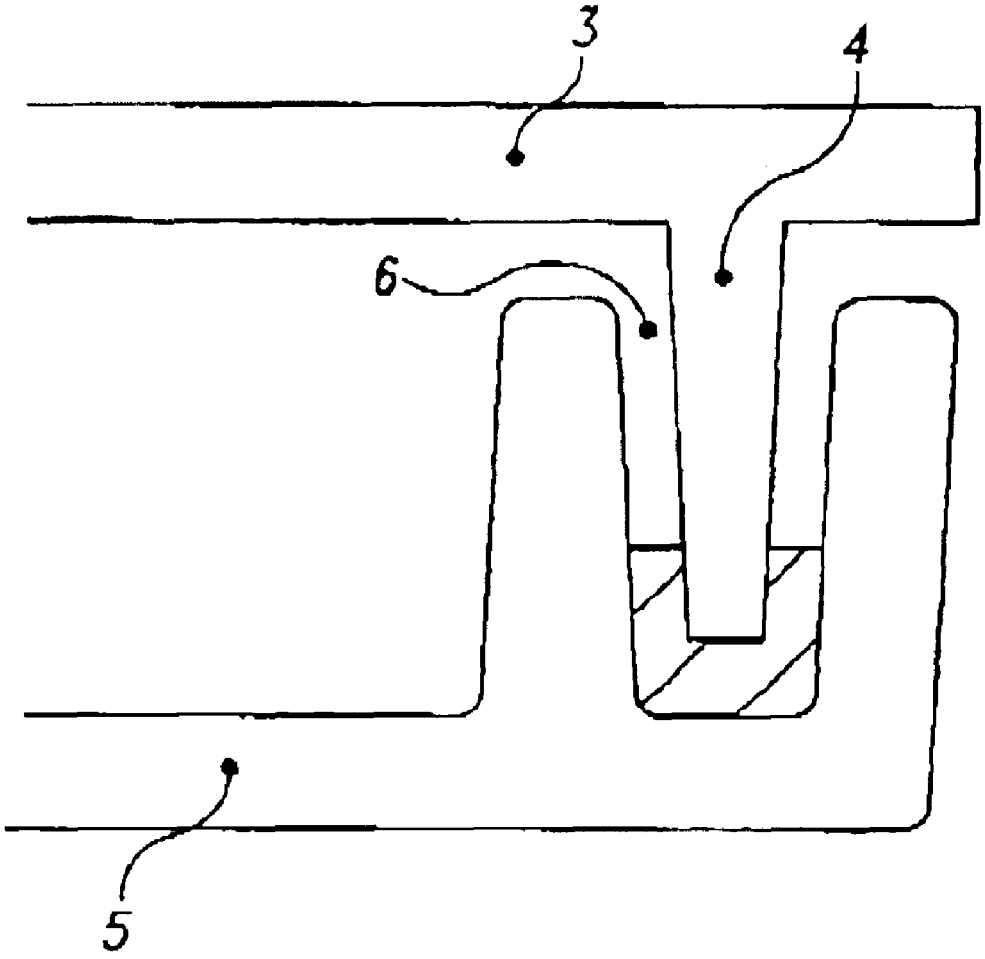
Fig. 1a (Prior Art)
FIG. 1*a* is a cross-sectional view of the prior art along line A—A of FIG. 1.
Figure 2:
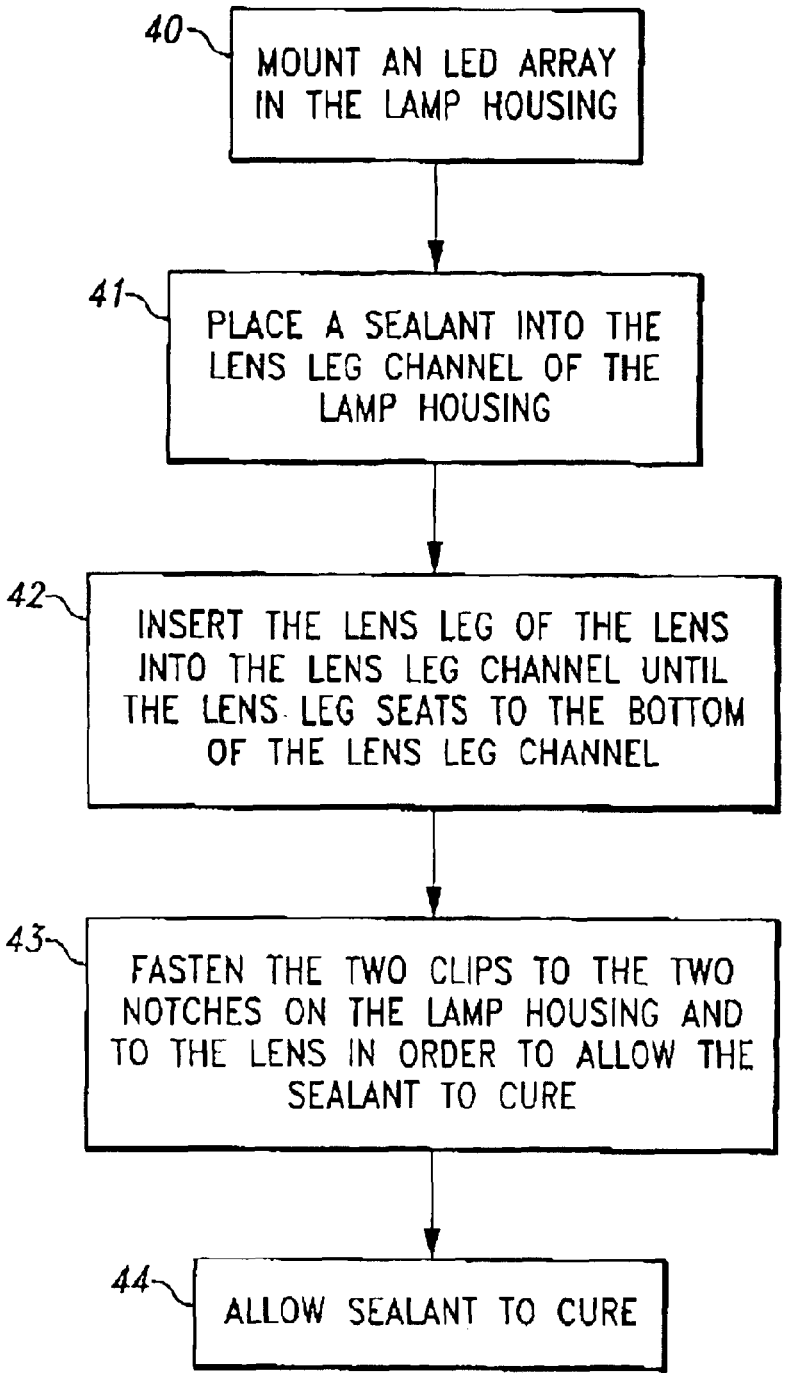
Fig. 2 (Prior Art)
FIG. 2 is a flow chart depicting the method of assembling the LED lamp assembly of FIG. 1.
Figure 3:
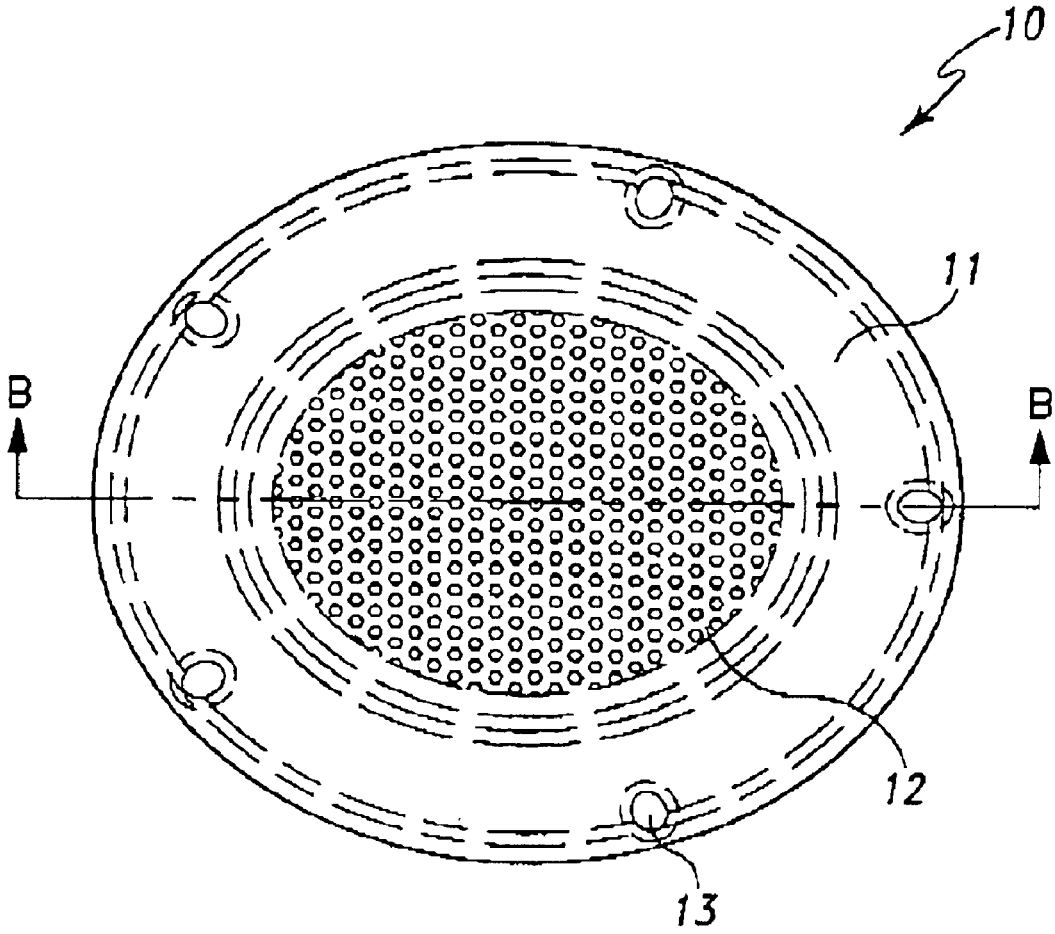
FIG. 3 is a front view of an exemplary embodiment of the subject invention.

FIG. 3 shows a front view of an exemplary embodiment of the subject invention. As shown in FIG. 3, one embodiment of the subject invention comprises a thin signal lamp assembly 10 for an automobile. Thin signal lamp assembly 10 comprises a lens 11, LED array 12, and a plurality of plastic stakes 13. While thin signal lamp assembly 10 utilizes an LED array, it will be appreciated by one skilled in the art that the subject invention can utilize a single LED or any other low profile light source.

Figure 4:
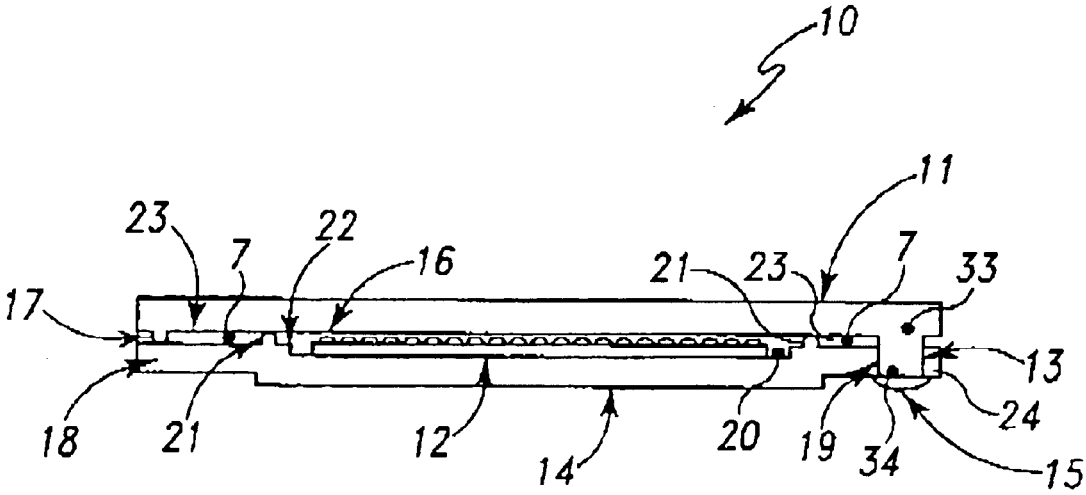
FIG. 4 is a cross-sectional view of the exemplary embodiment along line B—B of FIG. 3.

FIG. 4 shows a side cross-sectional view of thin signal lamp assembly 10 along line B—B of FIG. 3. As shown in FIG. 4, lens 11 is attached to a lamp housing 14 by plurality of plastic stakes 13 and a plurality of mushroom caps 15. It will be appreciated by one skilled in the art that lens 11 and lamp housing 14 can be manufactured with a variety of materials and processes known in the art.

Figure 5:
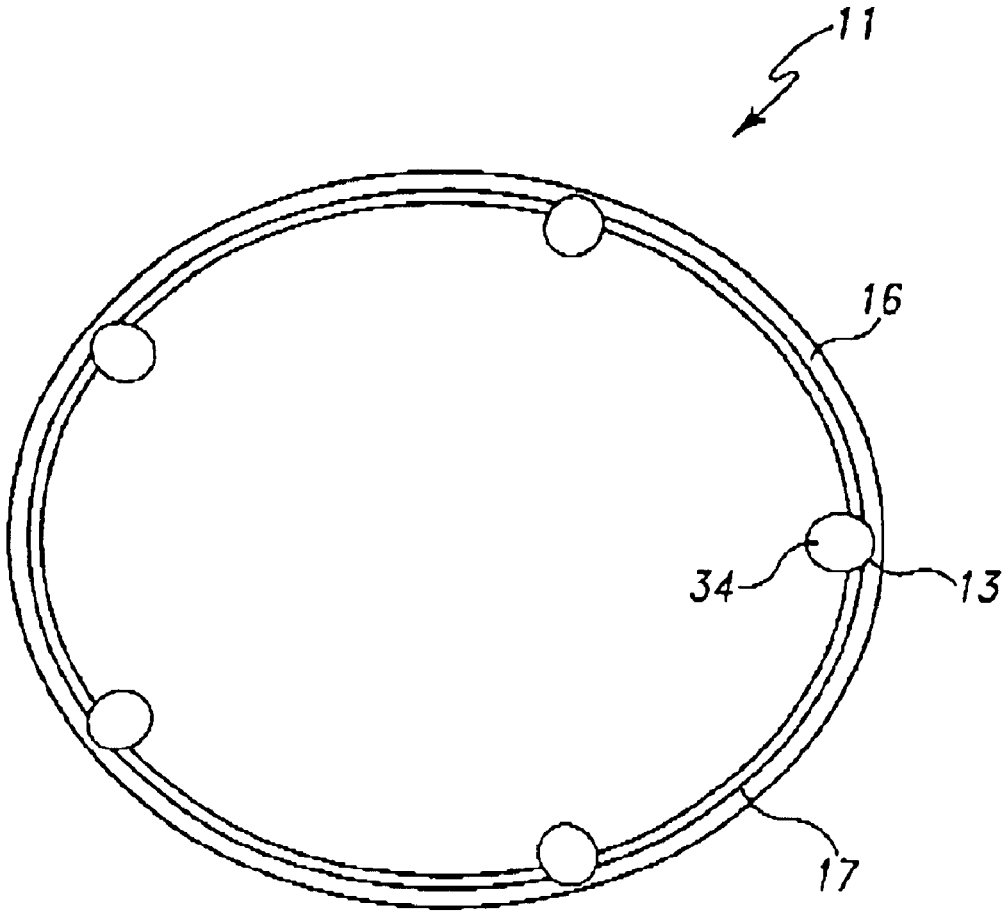
FIG. 5 is a rear view of a lens utilized in the exemplary embodiment of FIG. 3.

FIG. 5 shows a rear view of lens 11. As shown in FIG. 5, plastic stakes 13 are located on lens' 11 back side 16 and are arranged sporadically along the periphery of lens 11. Lens 11 further comprises a lens rib 17 located around the periphery of the lens in between plastic stakes 13. While lens rib 17 is located in between plastic stakes 13 in this embodiment, it will be appreciated by one skilled in the art that the lens rib can be located anywhere on the periphery of the lens as long as the lens rib forms a seal channel 23 with a lamp housing rib 21 (shown in FIG. 4). Referring back to FIG. 4, each of the plurality of plastic stakes have a bottom 33 that is either anchored to or integral with back side 16 of lens 11 and a top 34 that is integral with one of the plurality of mushroom caps 15. While FIGS. 3 and 5 show lens 11 with five plastic stakes 13, it will be appreciated by one skilled in the art that the subject invention can comprise any number of plastic stakes.

Figure 6:
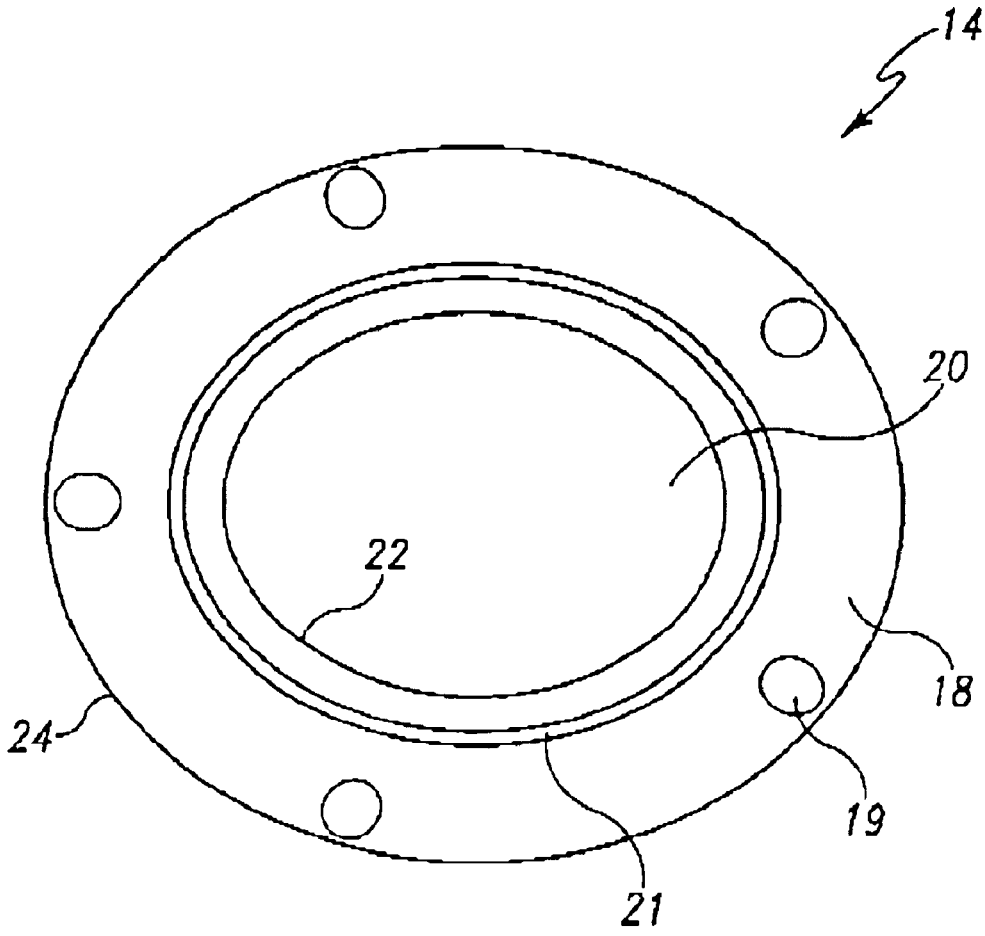
FIG. 6 is a front view of a lamp housing utilized in the exemplary embodiment of FIG. 3.

Referring back to FIG. 4, lens 11 is heat staked to lamp housing 14. As used herein, the terms "heat staked" and "heat staking" refer to a process where a heating device, such as an electric anvil, is used to heat treat a plurality of plastic stakes located on a lens or a lamp housing so that the plurality of plastic stakes hold the lens and the lamp housing together. The particular method for heat staking lens 11 to lamp housing 14 for the present embodiment is described below in relation to FIG. 10. FIG. 6 shows a front view of lamp housing 14. As shown in FIG. 6 and in FIG. 4, lamp housing 14 comprises a flange 18 and a holding compartment 20. Flange 18 contains a plurality of receiving holes 19 located sporadically around lamp housing's 14 outer periphery 24 and holding compartment 20 contains LED array 12 (shown in FIG. 4). The location of each of the plurality of receiving holes 19 corresponds to the location of each of the plurality of plastic stakes 13. While FIG. 6 shows lamp housing 14 with five receiving holes, it will be appreciated by one skilled in the art that any number of receiving holes can be used with the subject invention, so long as, the number of the receiving hole(s) equals the number of plastic stake(s). Lamp housing rib 21 is located adjacent to flange 18 around lamp housing's 14 inner periphery 22. Lamp housing rib 21 is formed around inner periphery 22 of lamp housing 14 so that the lamp housing rib and lens rib 17 form seal channel 23 (shown in FIG. 4).

Referring back to FIG. 4, array of LEDs 12 is located in holding compartment 20 of lamp housing 14. It will be appreciated by one skilled in the art that the LED array can be attached or held to the holding compartment of the lamp housing in a number of ways known to those skilled in the art including, but not limited to, gluing or screwing the LED array to the lamp housing or trapping the LED array in between the lens and the lamp housing. Further, it will be appreciated by one skilled in the art that LED array 12 can be electrically connected in a number of ways known to those skilled in the art including, but not limited to, electronically connecting wires from the power source to wire leads located on the LED array. While the present embodiment of the subject invention utilizes an LED array as a light source, it will be appreciated by one skilled in the art that any type of light source can be used in the subject invention and the light source may comprise a plurality of light sources that may or may not be arranged in an array.

Referring to FIG. 4, lens 11 is heat staked to lamp housing 14 so that the lens' back side 16 interacts and interfaces with lamp housing rib 21 and its lens rib 17 interacts and interfaces with flange 18 of lamp housing 14. A more detailed description of the heat staking process is described below in conjunction with FIG. 10. Lamp housing rib 21 and lens rib 17 define seal channel 23 which contains a sealant 7. It will be appreciated by one skilled in the art that the sealant 7 of the subject invention can comprise any number of sealants including, but not limited to, a silicon sealant, such as a room temperature vulcanization sealant (hereinafter referred to as RTV). Sealant 7 acts to seal and attach lens 11 to lamp housing 14. Plurality of plastic stakes 13 are each contained by one of the corresponding plurality of receiving holes 19 and each of the plurality plastic stakes and receiving holes are covered by one of the plurality of mushroom caps 15. Plurality of plastic stakes 13, plurality of mushroom caps 15 and plurality of receiving holes 19 attach lens 11 to lamp housing 14.

Figure 7:
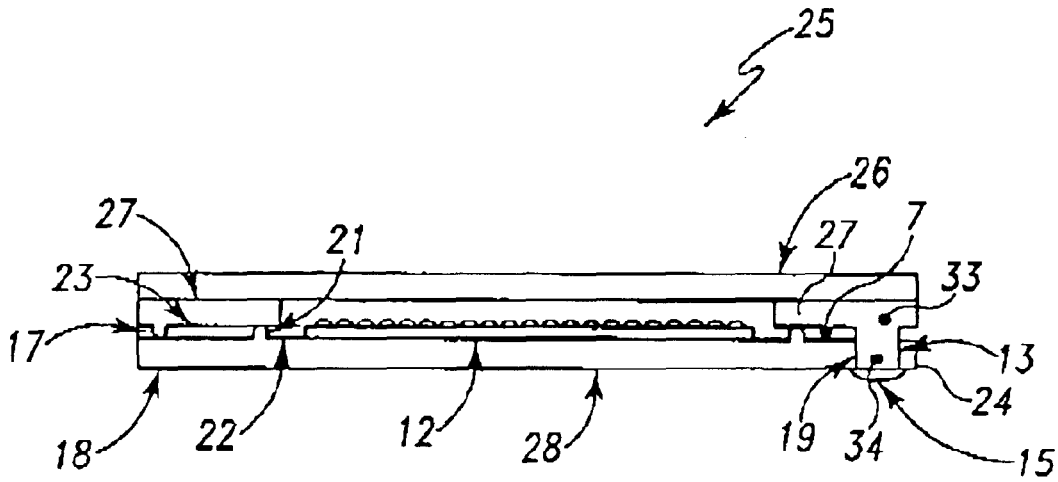
FIG. 7 is a cross-sectional view along line B—B of FIG. 3 of an exemplary embodiment of the subject invention containing a lens frame.
Figure 8:
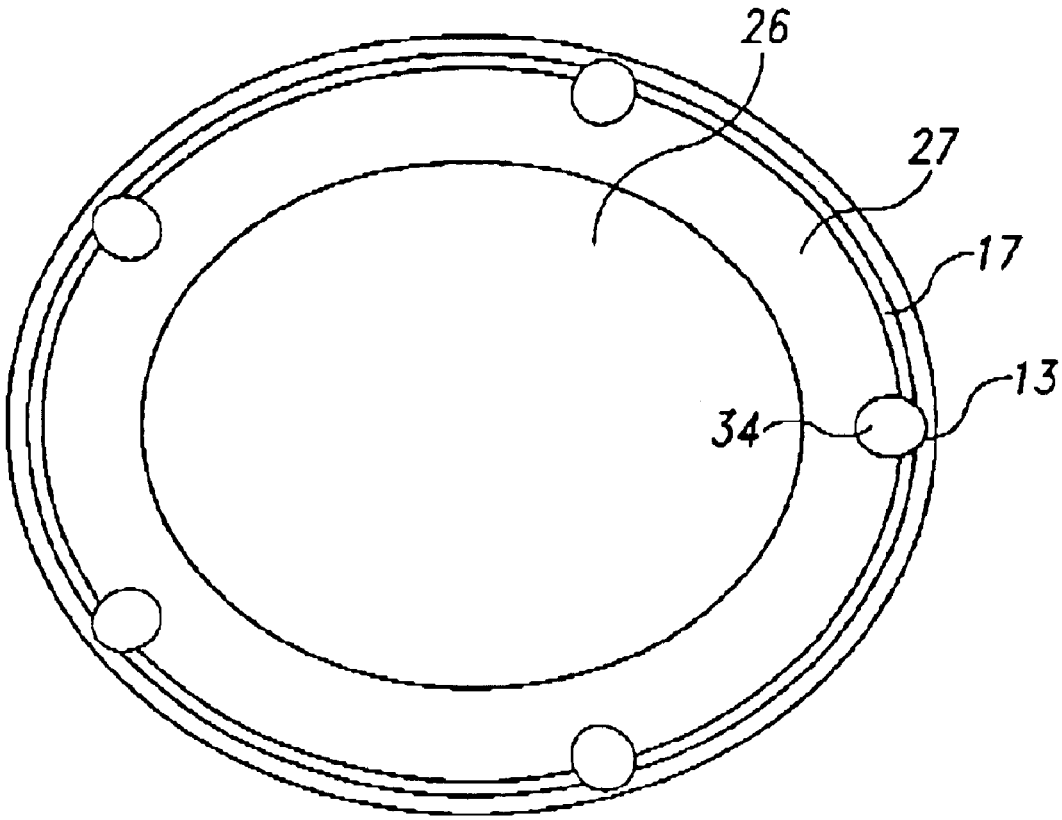
FIG. 8 is a rear view of a lens and the lens frame utilized in the exemplary embodiment of FIG. 7.

FIG. 7 shows a cross-sectional view of another exemplary embodiment of the subject invention along line B—B of FIG. 3. As shown in FIG. 7, this exemplary embodiment of the subject invention comprises a thin signal lamp assembly 25 having an outer lens 26 and a lamp housing 28. Outer lens 26 comprises a lens frame 27 located around the periphery of outer lens 26. FIG. 8 shows a rear view of outer lens 26 and lens frame 27. As shown in FIG. 8, lens frame 27 comprises plurality of plastic stakes 13 and lens rib 17. Plastic stakes 13 are arranged sporadically along the periphery of lens frame 27 and lens rib 17 is located around the periphery of lens frame 27 in between plastic stakes 13. It will be appreciated by one skilled in the art that lens rib 17 does not have to be located in between plastic stakes 13, but can be located anywhere around the periphery of the lens frame as long as the lens rib forms seal channel 23 with the lamp housing rib 21. As shown in FIG. 7, each of the plurality of plastic stakes 13 have bottom 33 that is either integral with or anchored to lens frame 27 and top 34 that is integral with mushroom cap 15. While FIG. 8 shows that this exemplary embodiment utilizes five plastic stakes, it will be appreciated by one skilled in the art that any number of plastic stakes can be used. In this embodiment, lens frame 27 is made of an opaque material and outer lens 26 is made of a translucent material. However, it will be realized by one skilled in the art that many types of materials and manufacturing processes can be used to construct the outer lens and lens frame.

Figure 9:
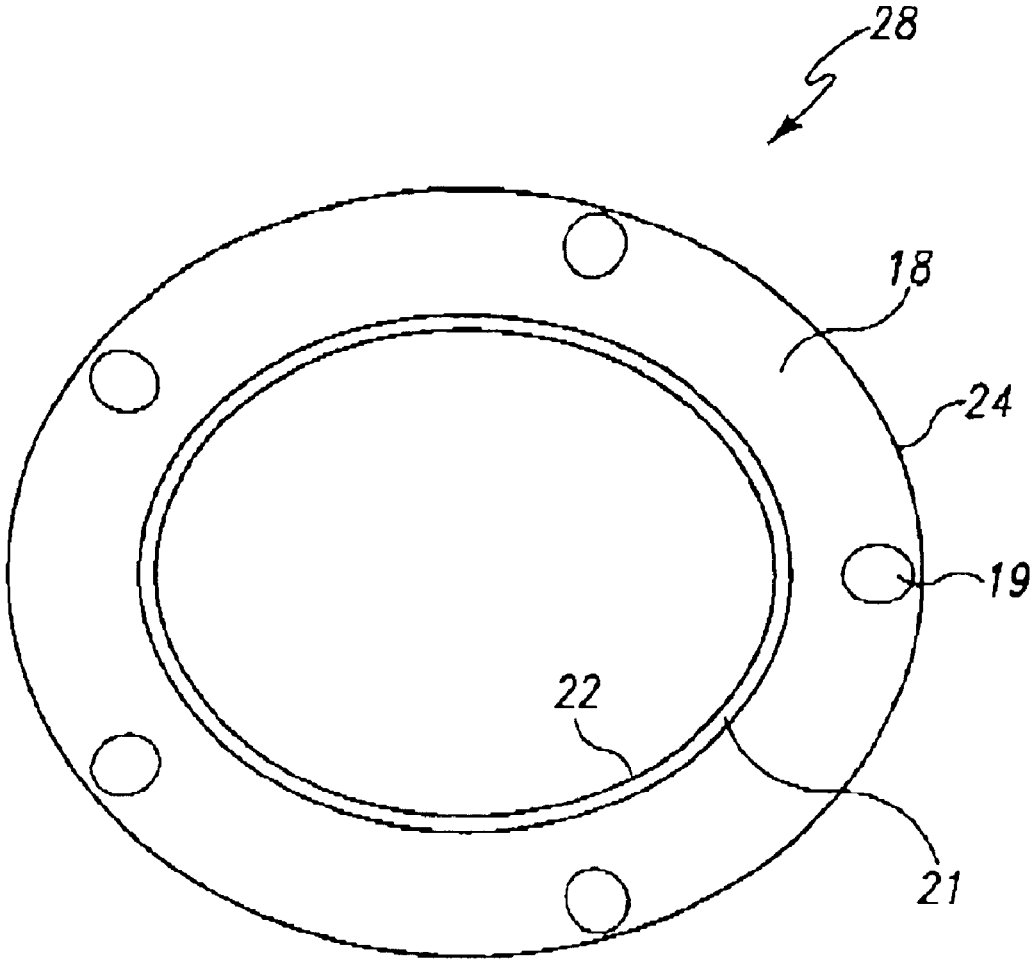
FIG. 9 is a front view of a lamp housing utilized in the exemplary embodiment of FIG. 7.

Referring back to FIG. 7, lamp housing 28 is heat staked to lens frame 27 and is covered by outer lens 26. FIG. 9 shows a front view of lamp housing 28. As shown in FIG. 9, lamp housing 28 comprises lamp housing rib 21 located around inner periphery 22 and plurality of receiving holes 19 located sporadically around outer periphery 24. The location of each receiving hole 19 corresponds in location to the location of each of the plurality of plastic stakes 13. While FIG. 9 shows lamp housing 28 with five receiving holes, it will be appreciated by one skilled in the art that any number of receiving holes can be used in the subject invention, so long as, the number of receiving holes equals the number of plastic stakes.

Referring back to FIG. 7, lamp housing 28 further comprises LED array 12. LED array 12 is located in the center of lamp housing 28 and is encircled by lamp housing rib 21. Outer lens 26 is heat staked to lamp housing 28 so that lens rib 17 interacts with lamp housing 28 and, so that, lens frame 27 interacts with lamp housing rib 21. Lens rib 17 and lamp housing rib 21 define seal channel 23 that contains sealant 7. Sealant 7 acts to seal and attach lens frame 27 to lamp housing 28. Plastic stakes 13 are each contained by one of the corresponding receiving holes 19 and each of the plurality of receiving holes 19 and plastic stakes 13 are covered by one of the plurality of mushroom caps. Plurality of plastic stakes 13, plurality of receiving holes 19 and plurality of mushroom caps 15 attach outer lens 26 and lens frame 27 to lamp housing 28.

Figure 10:
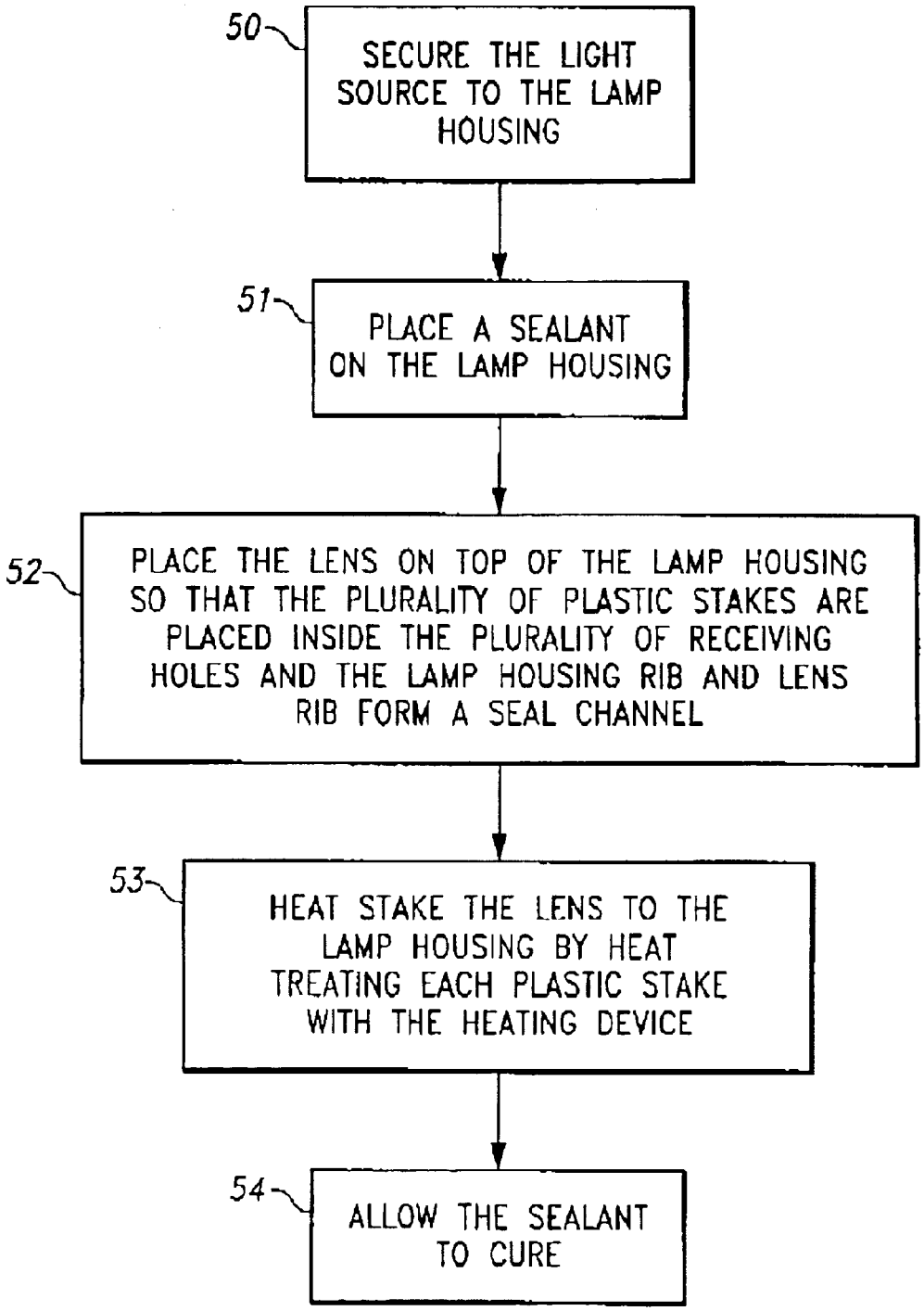
FIG. 10 is a flow chart of the method of assembling an exemplary embodiment of the subject invention.

FIG. 10 shows a flow chart of the method utilized to assemble an exemplary embodiment of the subject invention. As shown in FIG. 10, the method comprises of the following steps. In step 50, the LED array is secured to the lamp housing so that the LED array is surrounded by the lamp housing rib. In step 51, a sealant is placed on the lamp housing near the lamp housing rib. It will be appreciated by one skilled in the art that the sealant could alternatively be placed on the lens or lens frame adjacent the inside edge of the lens rib. During step 52, the lens is placed over the lamp housing so that the plastic stakes fit into the receiving holes and the lens rib and the lamp housing rib form a seal channel to contain the sealant. In step 53, a heating device, such as an electric anvil, is utilized to heat stake the lens to the lamp housing by heat treating each plastic stake so that each plastic stake forms a mushroom cap that covers both the plastic stake and corresponding receiving hole. It will be appreciated by one skilled in the art that any number of heating devices can be utilized to heat treat the plastic stakes. Furthermore, it will be appreciated by one skilled in the art that the caps of the subject invention are not limited to the mushroom caps but rather can be any type of structure located on the top of each of the plastic stakes that attaches the lens to the lamp housing. Once the mushroom cap is formed, the heating device is withdrawn and the plastic stakes are allowed to cool. In this manner, each of the plastic stakes and mushroom caps attach the lens to the lamp housing. In step 54, the sealant is allowed to cure and seal the lens to the lamp housing. The lamp assembly created by this method can be inserted into the vehicle by any number of means known to those skilled in the art.

While the subject invention has been described in considerable detail with references to particular embodiments thereof, such is offered by way of non-limiting examples of the invention as many other versions are possible. For example, instead of heat staking the lens to the lamp housing, the lamp housing can comprise a plurality of plastic stakes that are received by a plurality of receiving holes on the lens that allow the lamp housing to be heat staked to the lens in the same manner as already described. Further, instead of having the lens rib located on the lens or lens frame and the lamp housing rib located on the lamp housing, the ribs can both be located on the lamp housing or, alternatively, both be located on the lens or lens frame. The ribs can be located in either location so long as they form a seal channel to hold a sealant. It is anticipated that a variety of other modifications and changes will be apparent to those having ordinary skill in the art and that such modifications and changes are intended to be encompassed within the spirit and scope of the pending claims.

What is claimed is:

1. A thin lamp assembly comprising:

a. a lamp housing and a lens heat staked together;

b. a light source positioned in between the lens and the lamp housing;

c. a plurality of plastic stakes located on the lens' back side and sporadically around the lens' periphery;

d. a plurality of receiving holes located sporadically around the lamp housing's outer periphery wherein each of the plurality of receiving holes contains one of the plurality of plastic stakes; and e. a plurality of mushroom caps that each cover one of the plurality of plastic stakes and one of the plurality of receiving holes.

2. The thin lamp assembly of claim 1 wherein the light source comprises an LED array.

3. The thin lamp assembly of claim 1 wherein the light source comprises an LED array.

4. The thin lamp assembly of claim 1 further comprising a lens rib and a lamp housing rib located on the lens, so that the lens rib and lamp housing rib form a seal channel that contains a sealant.

5. The thin lamp assembly of claim 1 further comprising a lens rib and a lamp housing rib located on the lamp housing, so that the lens rib and lamp housing rib form a seal channel that contains a sealant.

6. The thin lamp assembly of claim 1 further comprising a lens rib located around the lens' periphery.

7. The thin lamp assembly of claim 6 further comprising a lamp housing rib located around the lamp housing's inner periphery, so that a seal channel is located between the lens rib and the lamp housing rib.

8. The thin lamp assembly of claim 7 further comprising a sealant located in the seal channel.

9. The thin lamp assembly of claim 8 wherein the sealant comprises a silicon sealant.

10. The thin lamp assembly of claim 8 wherein the sealant comprises a RTV sealant.

11. The thin lamp assembly of claim 1 further comprising a lens frame located on the lens' back side so that the plurality of plastic stakes are located around the lens frame's periphery, the lens frame having and a lens rib located around the lens frame's periphery.

12. The thin lamp assembly of claim 11 further comprising a a lamp housing rib located around the lamp housing's inner periphery so that the lamp housing rib forms a seal channel with the lens rib.

13. The thin lamp assembly of claim 12 further comprising a sealant located in the seal channel.

14. A method of assembling a thin lamp assembly comprising the steps of:

a. providing a lamp housing having at least one light source and a plurality of receiving holes located sporadically around the lens' periphery;

b. providing a lens having a plurality of plastic stakes located sporadically around the lamp housing's outer periphery;

c. providing a seal channel;

d. placing a sealant into the seal channel;

e. placing the lens on top of the lamp housing so that the light source is enclosed by the lens and the lamp housing and the plurality of plastic stakes are inserted into the plurality of receiving holes; and f. heat staking each of the plurality of plastic stakes in order to heat stake the lens and the lamp housing together.

15. The method of assembling a thin lamp assembly of claim 14, wherein the lamp housing further comprises a lamp housing rib located around the lamp housing's inner periphery.

16. The method of assembling a thin lamp assembly of claim 15, wherein the lens further comprises a lens rib located around the lens' periphery.

17. The method of assembling a thin lamp assembly of claim 16, wherein the step of placing the lens on top of the lamp housing further comprises forming the seal channel in between the lamp housing rib and lens rib as the plurality of plastic stakes are inserted into the plurality of receiving holes.

18. The method of assembling a thin lamp assembly of claim 17, wherein the heat staking step comprises:

a. providing a heating device; and b. heat treating each of the plurality of plastic stakes with the heating device so that a plurality of mushroom caps form on the thin lamp assembly to cover each of the plurality of plastic stakes and each of the plurality of receiving holes.

19. The method of assembling a thin lamp assembly of claim 14 wherein the seal channel is formed by a lens rib and a lamp housing rib both located on the lamp housing.

20. The method of assembling a thin lamp assembly of claim 14 wherein the seal channel is formed by a lens rib and a lamp housing rib both located on the lens.

21. The method of assembling a thin lamp assembly of claim 14, wherein the light source comprises at least one LED.

22. The method of assembling a thin lamp assembly of claim 14, wherein the light source comprises an LED array.

23. A thin lamp assembly comprising:

a. a lamp housing having (i) a plurality of receiving holes located sporadically around the lamp housing's outer periphery; and (ii) a lamp housing rib located around the lamp housing's inner periphery;

b. a light source secured to the lamp housing;

c. a lens heat staked to the lamp housing, the lens having (i) a plurality of plastic stakes located on the lens' backside and sporadically around the lens' periphery; and (ii) a lens rib located on the lens' backside and around the lens' periphery;

d. a seal channel located in between the lens rib and lamp housing rib;

e. a sealant located in the seal channel; and f. a plurality of mushroom caps that each cover each of the plurality of plastic stakes and each of the plurality of receiving holes.

* * * * *